US006298864B1

(12) United States Patent
Gueret

(10) Patent No.: US 6,298,864 B1
(45) Date of Patent: Oct. 9, 2001

(54) DEVICE FOR APPLYING A FILM-FORMING COMPOSITION

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/239,886

(22) Filed: Jan. 29, 1999

(30) Foreign Application Priority Data

Jan. 30, 1998 (FR) ..... 98 01064

(51) Int. Cl.[7] ..... A45D 40/24
(52) U.S. Cl. ..... 132/317
(58) Field of Search ..... 132/218, 317, 132/320; 401/121, 122

(56) References Cited

U.S. PATENT DOCUMENTS

| | | | | |
|---|---|---|---|---|
| 3,033,213 | * | 5/1962 | Joss et al. | 132/218 |
| 3,132,653 | * | 5/1964 | Gazdik | 401/122 |
| 3,146,806 | * | 9/1964 | Ginsburg | 401/122 |
| 5,309,929 | * | 5/1994 | Toll | 132/218 |
| 5,690,130 | | 11/1997 | Gunderman et al. | 132/319 |
| 5,722,436 | * | 3/1998 | Vandromme et al. | 132/317 |

FOREIGN PATENT DOCUMENTS

| | | | | |
|---|---|---|---|---|
| 0640302 | | 8/1994 | (EP) . | |
| 2488111 | * | 2/1982 | (FR) | 132/218 |
| 2736248 | | 7/1995 | (FR) . | |
| 2745272 | | 2/1996 | (FR) . | |
| 2099292 | * | 12/1982 | (GB) | 132/218 |
| 9517837 | | 7/1995 | (WO) . | |

* cited by examiner

*Primary Examiner*—Todd E. Manahan
(74) *Attorney, Agent, or Firm*—Oliff & Berridge, PLC

(57) ABSTRACT

A device for forming a peel-off film in situ includes a film-forming composition, a receptacle containing the composition, an applicator including an applicator element, and a wiper member inside the receptacle. The applicator element and the wiper member are organized in such a manner that, after wiping, and on being moved in contact with the skin, the applicator element leaves a film of film-forming composition which, once dry, can be peeled off and has a density per unit mass that preferably lies in the range 1 mg/cm$^2$ to 15 mg/cm$^2$. The film-forming composition preferably includes at least one active substance for cosmetic and/or pharmaceutical treatment of the skin.

24 Claims, 1 Drawing Sheet

DEVICE FOR APPLYING A FILM-FORMING COMPOSITION

The present invention relates to the general field of films used in contact with the skin for the purpose of exerting thereon cosmetic and/or curative action.

BACKGROUND OF THE INVENTION

Films are already known which are applied temporarily to the skin to extract impurities therefrom and/or to release a substance that acts through the skin, with such films also being known as "patches".

The use of such films is made difficult by the fact that a shape is not always available that is appropriate for the region of the face or the body that is to be treated.

In addition, such films have a multilayer structure and are relatively thick, and they are therefore fairly uncomfortable on the skin.

Furthermore, their appearance and their thickness do not enable the user to wear them in discreet manner.

Compositions are also known which, on drying, transform into films that can be peeled off, such compositions being known as film-forming compositions, and being packaged in pots or tubes for application to the face in relatively coarse manner by means of a finger or a spatula in order to form a mask.

Irregular application of such film-forming compositions leaves visible traces, which means that under these circumstances also, the user cannot go out or go to work without other people noticing.

There thus exists a need for a film that is easy to put into place whatever the region of the face or body that is to be treated, that is comfortable, and that can also be worn discreetly, if necessary.

OBJECTS AND SUMMARY OF THE INVENTION

This is achieved by the invention by means of a device enabling a film-forming composition to be applied to the skin, the device comprising:

a receptacle containing said film-forming composition;

an applicator including an applicator element; and a wiper member inside the receptacle, the applicator element and the wiper member being organized in such a manner that after being wiped and on being moved in contact with the skin, the applicator element leaves a film of the film-forming composition which, on drying, can be peeled off and presents a density per unit area that preferably lies in the range 1 mg/cm$^2$ to 15 mg/cm$^2$.

By means of the invention, the user can easily deposit a substantially constant thickness of the film-forming composition on the skin.

The user can easily make the film in situ to the desired size.

The film is comfortable because it is thin and flexible, and in addition it can be made difficult to see by people around the user, being covered where necessary by makeup.

The film-forming composition preferably includes at least one active substance for pharmaceutical and/or cosmetic treatment of the skin.

The applicator element preferably has external capillarity, i.e. the film-forming composition is deposited on its surface only.

The applicator element preferably has a covering on its surface that is constituted by fine flexible bristles advantageously put into place by an electrostatic method on a non-porous support.

The bristles are preferably 0.2 mm to 1.5 mm long and the wiper member is preferably constituted by a block of foam.

When the applicator element has external capillary, it does not absorb the composition in depth, such that when it is pressed against the skin there is no danger of it reabsorbing a significant amount of composition that has already been deposited thereon. In contrast, when the applicator element is constituted by a foam having open cells, then the foam can reabsorb, to some extent, the composition that has already been deposited on the skin.

The invention also provides a method of forming a peel-off film in situ and of the desired format on the surface of the skin, the method comprising the steps consisting in:

applying on the skin by means of an applicator element, preferably having external capillarity, a layer of substantially constant thickness of a film-forming composition coming from a receptacle fitted with a wiper member, the applicator element and the wiper member being selected in such a manner that the applicator element leaves a peel-off film on the surface of the skin, the density per unit area of the film lying in the range 1 mg/cm$^2$ to 15 mg/cm$^2$, the film-forming composition preferably including at least one active substance for pharmaceutical and/or cosmetic treatment of the skin; and allowing the film-forming composition deposited on the skin by the applicator element to dry.

The invention also provides a cosmetic treatment method, comprising the steps consisting in:

applying on the skin by means of an applicator element, preferably having external capillarity, a layer of substantially constant thickness of a film-forming composition coming from a receptacle fitted with a wiper member, the applicator element and the wiper member being selected in such a manner that the applicator element leaves a peel-off film on the surface of the skin, the density per unit area of the film lying in the range 1 mg/cm$^2$ to 15 mg/cm$^2$, the film-forming composition further including one or more active substances having a cosmetic effect on the skin;

leaving the film-forming composition deposited on the skin by the applicator element for the length of time required by the treatment; and removing the film.

The invention also provides the use of at least one active substance having a curative effect on the skin in the manufacture of a film-forming composition for application to the skin to form a peel-off film, the film-forming composition, once dry, constituting a film on the surface of the skin, the density per unit area of the film lying in the range 1 mg/cm$^2$ to 15 mg/cm$^2$.

The invention also provides a patch comprising a film-forming composition that has polymerized and at least one active substance for cosmetic and/or pharmaceutical treatment of the skin, the thickness of the patch being substantially constant and its density per unit area lying in the range 1 mg/cm$^2$ to 15 mg/cm$^2$.

BRIEF DESCRIPTION OF THE DRAWING

Other characteristics and advantages of the present invention appear on reading the following detailed description of a non-limiting embodiment of the invention, and on examining the accompanying drawing, in which.

MORE DETAILED DESCRIPTION

Figure 1:
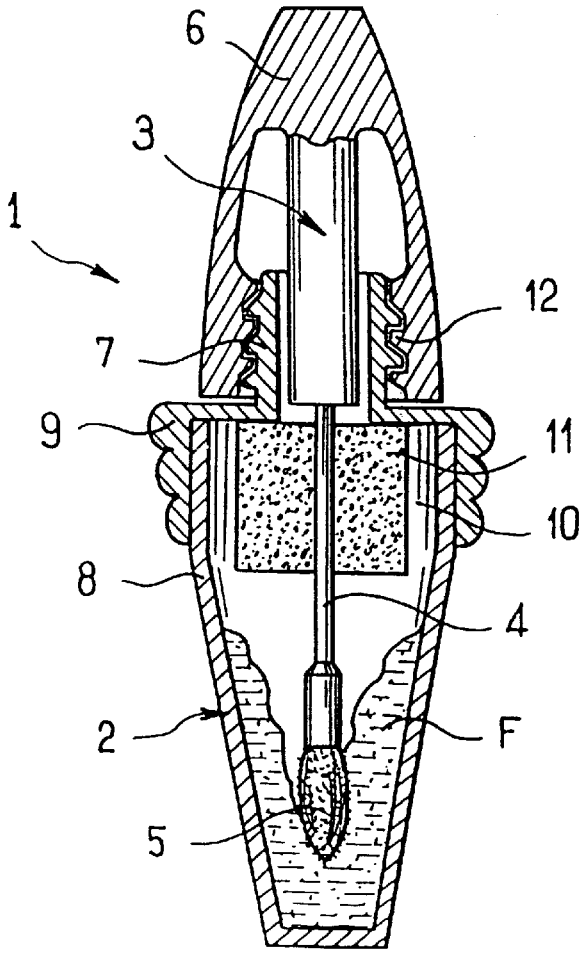
FIG. 1 is a diagrammatic section of a device of the invention enabling a film-forming composition to be applied to the skin.

The packaging and applicator device 1 shown in FIG. 1 is compact, making it easy to carry about in a pocket or a handbag. It comprises a reservoir-forming receptacle 2 and an applicator 3 having an advantageously flexible stalk 4 fitted at one end with an applicator element 5 and at its other end with a handle member 6.

The receptacle 2 comprises an assembly of an open-topped body 8 and a shouldered endpiece 9 on which the neck 7 of the receptacle is formed.

A wiper member 11 constituted by a block of open-celled foam and provided in its center with an axial bore through which the applicator element 5 and the stalk 4 of the applicator 3 can pass is fixed to the inside face of the shouldered endpiece 9. The wiper member 11 is secured by heat-sealing, for example. An annular gap 10 is left between the radially outer surface of the wiper member 11 and the radially inside surface of the body 8, so as to leave room for the foam to expand radially when the applicator element is passing through it.

The handle member 6 has an inside thread 12 which is engaged on an outside thread of the neck 7 to close the receptacle 2 in leakproof manner, the stalk 4 then passing through the wiper member 11 and the applicator element 5 being situated close to the bottom of the body 8.

The neck 7 is not threaded at its top end so that if a deposit is formed on the neck 7, then the deposit does not prevent the handle element 6 being subsequently screwed back on.

The receptacle 2 is filled with a colorless film-forming composition F comprising one or more polymers and one or more solvents.

Suitable polymers include polyvinyl alcohol, soluble latex, EVA, polyurethane, and acrylic resin, and suitable solvents include, for example water and alcohol, with the solvent(s) being selected as a function of the polymer(s) used.

In the embodiment described, the applicator element 5 is elongate and circularly symmetrical in shape.

It is constituted by a non-porous support fitted to the stalk 4 or integrally formed therewith, and covered in fine flexible bristles, e.g. of nylon, of length lying in the range 0.2 mm to 1.5 mm, and preferably being about 1 mm, which bristles are put into place on said support by electrostatic means.

To use the device 1, the user unscrews the handle member 6 and extracts the applicator element 5 from the inside of the receptacle 2 through the wiper member 11.

Figure 2:
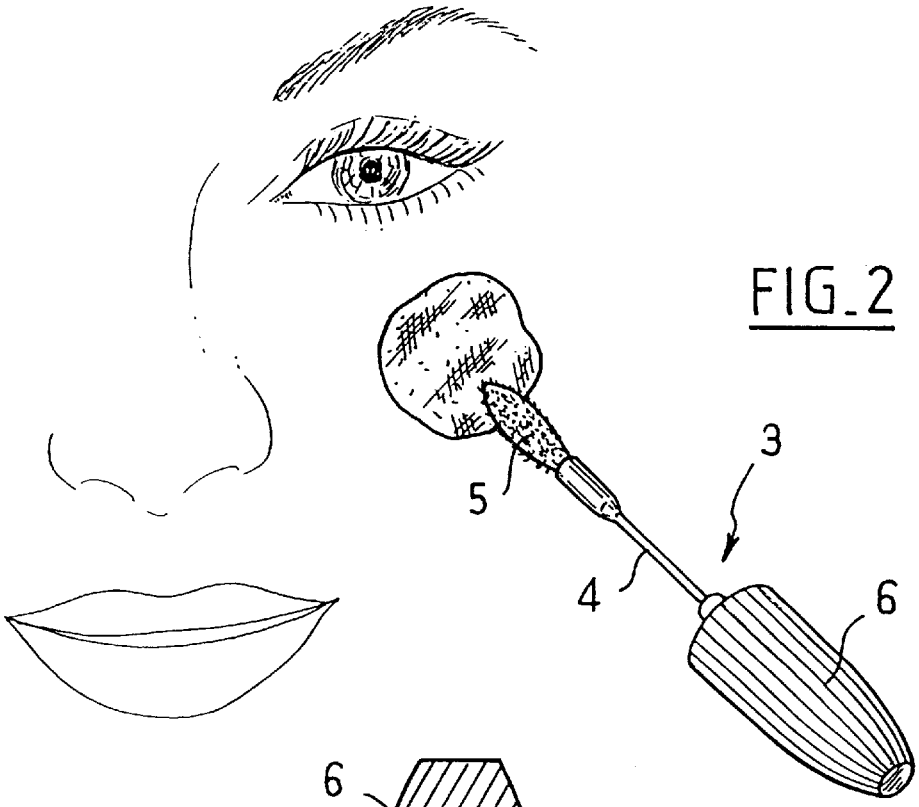
FIG. 2 shows the film-forming composition being applied to the skin by means of the applicator of the FIG. 1 device.

The applicator element 5 and the wiper member 11 are organized so that once the applicator element 5 has been extracted from the receptacle 2, there remains on its surface a thin thickness of unpolymerized film-forming composition F, which composition can be applied in user-desired format on the skin in the region of the face or body that is to be treated, as shown in FIG. 2.

The thickness of composition left on the skin is a function of the length of the bristles on the applicator element 5.

In the example described, the film-forming composition F polymerizes as the solvent(s) it contains evaporate(s).

It will be understood that by means of the invention, it is easy for the user to make a film whose size corresponds exactly to the zone to be treated.

It may be used to cover a spot or a blackhead, for example.

It should also be observed that in the example described, the flexibility of the stalk 4 makes it possible to apply the composition gently and thus without irritating the zone treated.

Once the film-forming composition has polymerized, i.e. once the film is dry, the user can where appropriate cover it in makeup so as to make it practically undetectable.

The film is removed by unsticking it from the skin, or in the event that the polymers used are water-soluble polymers whose solvent is aqueous and whose polymerization is reversible, by washing in water.

On being removed, the film can cleanse the skin of impurities.

In general, the film-forming composition F deposited on the skin, once dry, constitutes a film whose density per unit area lies in the range 1 mg/cm$^2$ to 15 mg/cm$^2$, and preferably in the range 1 mg/cm$^2$ to 10 mg/cm$^2$, and more preferably in the range 1.5 mg/cm$^2$ to 5 mg/cm$^2$.

The time required for the film-forming composition F to dry on the skin lies in the range 1 minute to 5 minutes, and preferably in the range 2 minutes to 4 minutes.

The film-forming composition F, when applied to the skin, leaves a fine film that is comfortably flexible and practically invisible. It can contain any of the following active substances for cosmetic or curative purposes: tannins, waxes, concealers, antiwrinkle agents, anti-oxidants, free radical scavengers, moisturizers, depigmenting agents, liporegulators, slimming agents, anti-acne agents, antipsoriatic agents, antidandruff agents, antihistamines, anti-aging agents, anti-inflammatory agents, fresheners, vascular protectors, antibacterial agents, antifungal agents, antiperspirants, skin conditioners, immunomodulators, nourishing agents, and anesthetics.

The film of the film-forming composition deposited on the skin tends to dry more quickly on its surface than where it is in contact with the skin.

The film-forming composition F can thus remain in contact with the skin without polymerizing immediately so as to enable the active substances contained within it to diffuse into the skin.

In addition, when the active substances are volatile, evaporation thereof is slowed down to some extent by the fact that the film begins by drying on the surface.

By way of example, a film-forming composition F has been made having the following composition (% by weight):

75% water;

5% ethanol;

5% hydrosoluble active substance such as caffeine;

10% pseudo-latex polyurethane polymer; and

5% conserving agent.

This composition is for application to the face to treat bags under the eyes.

Another film-forming composition has been made having the following formulation (% by weight):

70% water;

15% polyvinyl alcohol;

10% hydrosoluble active substance such as a vegetable extract; and

5% liposoluble active substances such as salicylic acid.

This composition is for application to zones of erythema and can be kept on all day.

Naturally, the invention is not limited to the embodiment described above.

In particular, it is possible to use applicators other than that shown in the figures, for example applicators having a stalk with a bend, or having an applicator element of a particular shape that is not circularly symmetrical, but adapted to treating a specific region of the face.

The applicator may have one or more slots and/or cells for retaining the composition by capillarity.

What is claimed is:

1. A device for forming a peel-off film in situ and of the desired format on the surface of the skin, the device comprising:

a film-forming composition, wherein said composition is capable of forming a film that can be peeled off once dry;

a receptacle containing said composition;

an applicator including an applicator element; and a wiper member inside the receptacle, the applicator element and the wiper member being organized in such a manner that, after wiping, and on being moved in contact with the skin, the applicator element leaves a film of film-forming composition.

2. A device according to claim 1, wherein said applicator element has external capillarity.

3. A device according to claim 2, wherein the length of the bristles lies in the range 0.2 mm to 1.5 mm.

4. A device according to claim 3, wherein the length of the bristles is about 1 mm.

5. A device according to claim 2, wherein said applicator elements has on its surface a covering constituted by bristles.

6. A device according to claim 5, wherein said bristles are put into place on a non-porous support by an electrostatic method.

7. A device according to claim 1, wherein said film-forming composition comprises a hydrosoluble polymer and an aqueous solvent.

8. A device according to claim 1, wherein the film deposited on the skin has a density per unit area lying in the range 1.5 mg/cm$^2$ to 5 mg/cm$^2$.

9. A device according to claim 1, wherein said film-forming composition is selected in such a manner that its drying time on the skin lies in the range 1 minute to 5 minutes.

10. A device according to claim 9, wherein said film-forming composition is selected in such a manner that is drying time on skin lies in the range of 2 minutes 4 minutes.

11. A device according to claim 1, wherein said wiper member is constituted by a block of foam.

12. A device according to claim 11, wherein said wiper member comprises a block of an open-celled foam.

13. A device according to claim 1, wherein said film-forming composition comprises at least one polymer selected from the group constituted by: polyvinyl alcohol, soluble latex, EVA, polyurethane, and acrylic resin.

14. A device according to claim 13, wherein the polymerization of said film-forming composition is reversible so that the film deposited on the skin can be washed off.

15. A device according to claim 1, wherein the applicator comprises a stalk provided at one end with the applicator element and at its other end with a handle element also constituting a closure cap for the receptacle, the handle element being internally threaded and the receptacle having a neck that is externally threaded, over its bottom portion only, for screw engagement with the handle element.

16. A device according to claim 15, wherein the stalk is flexible.

17. A device for forming a peel-off film in situ and of desired format on the surface of the skin, the device comprising:

a film-forming composition;

a receptacle containing said composition;

an applicator including an applicator element; and a wiper member inside the receptacle, the applicator element and the wiper member being organized in such a manner that, after wiping, and on being moved in contact with the skin, the applicator element leaves a film of film-forming composition which, once dry, can be peeled off, and had a density per unit mass that lies in the range of 1 mg/cm$^2$ to 15 mg/cm$^2$.

18. A device for forming a peel-off film in situ and of desired format on the surface of the skin, the device comprising:

a film-forming composition;

a receptacle containing said composition an applicator including an applicator element; and a wiper member inside the receptacle, the applicator element and the wiper member being organized in such a manner that, after wiping, and on being moved in contact with the skin, the applicator element leaves a film of film-forming composition which, once dry, can be peeled off, the film-forming composition including at least one active substance for cosmetic and/or pharmaceutical treatment of the skin.

19. A device for forming a peel-off film in situ and of desired format on the surface of the skin, the device comprising:

a film-forming composition;

a receptacle containing said composition;

an applicator including an applicator element; and a wiper member inside the receptacle, the applicator element and the wiper member being organized in such a manner that, after wiping, and on being moved in contact with the skin, the applicator element leaves a film of film-forming composition which, once dry, can be peeled off and has a density per unit mass that lies in the range 1 mg/cm$^2$ to 15 mg/cm$^2$, the film-forming composition including at least one active substance for cosmetic and/or pharmaceutical treatment of the skin.

20. A method of forming a peel-off film in situ and of the desired format on the surface of the skin, the method comprising:

applying on the skin by means of an applicator element a layer of substantially constant thickness of a film-forming composition coming from a receptacle fitted with a wiper member, the applicator element and the wiper member being selected in such a manner that the applicator element leaves a peel-off film on the surface of the skin, the density per unit area of the film lying in the range 1 mg/cm$^2$ to 15 mg/cm$^2$, and allowing the film-forming composition deposited on the skin by the applicator element to dry.

21. A method according to claim 20, wherein said applicator element has external capillarity.

22. A cosmetic treatment method, comprising the steps consisting in:

applying on the skin by means of an applicator element a layer of substantially constant thickness of a film-forming composition coming from a receptacle fitted with a wiper member, the applicator element and the wiper member being selected in such a manner that the applicator element leaves a peel-off film on the surface of the skin, the film-forming composition further including one or more active substances having a cosmetic effect on the skin;

leaving the film-forming composition deposited on the skin by the applicator element for the length of time required by the treatment; and removing the film.

23. A method according to claim 22, further comprising the steps consisting in:

applying makeup over the film on the film-forming composition after it has dried.

24. A method according to claim 22, wherein said applicator element has external capillarity.

* * * * *